US005890264A

United States Patent [19]

Shofner et al.

[11] Patent Number: 5,890,264

[45] Date of Patent: Apr. 6, 1999

[54] AEROMECHANICAL INDIVIDUALIZER

[75] Inventors: Frederick M. Shofner; Christopher K. Shofner, both of Knoxville, Tenn.

[73] Assignee: Premier Polytronics Limited, Coimbatore, India

[21] Appl. No.: 944,913

[22] Filed: Oct. 6, 1997

[51] Int. Cl.[6] ..... D01B 3/00

[52] U.S. Cl. ..... 19/205; 19/98; 19/99; 19/202; 19/203; 19/204

[58] Field of Search ..... 19/98, 99, 200, 19/202, 203, 204, 205

[56] References Cited

U.S. PATENT DOCUMENTS

| | | | |
|---|---|---|---|
| 2,404,708 | 7/1946 | Hertel | 19/115 |
| 3,057,019 | 10/1962 | Hertel | 19/65 |
| 4,219,908 | 9/1980 | Winch et al. | 19/99 |
| 4,512,060 | 4/1985 | Shofner | 19/200 |
| 4,534,086 | 8/1985 | Fehrer | 19/99 |
| 4,631,781 | 12/1986 | Shofner | 19/200 |
| 4,686,744 | 8/1987 | Shofner | 19/200 |
| 5,270,787 | 12/1993 | Shofner et al. | 356/238 |
| 5,321,496 | 6/1994 | Shofner et al. | 356/238 |
| 5,469,253 | 11/1995 | Shofner et al. | 356/238 |

FOREIGN PATENT DOCUMENTS

| | | | |
|---|---|---|---|
| 2532061 | 2/1977 | Germany | 19/202 |

*Primary Examiner*—William Stryjewski
*Attorney, Agent, or Firm*—Carter & Schnedler, P.A.

[57] ABSTRACT

An aeromechanical individualizer for individualizing entities within a fiber sample includes a cylindrical rotating beater wheel, having a non-permeable cylindrical surface and having carding elements, such as pins or wire points, on the cylindrical surface. A cylindrical feed roller and feed plate supply the fiber sample to the beater wheel in the form of a beard at a first point along the rotational path thereof. A nozzle directs a gas flow across the feed plate and the beard such that fibers are dragged from the feed plate into engagement with the carding element. At a second point along the rotational path of the beater wheel there is a doffer for removing entities of the beater wheel. An enclosure surrounds the beater wheel and substantially prevents the ingress or egress of the gas except gas flow which enters via the nozzle at the first point and which exits at the second point.

3 Claims, 2 Drawing Sheets

10
44
25
42
40
38
12
84
24
82
53
22
20
36
32
80
48
46
50
56
55
30
54
26
60
28
66
52
62
64
14
34
16
18

AEROMECHANICAL INDIVIDUALIZER

BACKGROUND OF THE INVENTION

The present invention relates generally to the testing of fiber samples and, more particularly, to apparatus for individualizing single fibers and other entities in textile fiber samples for testing purposes.

Testing of fiber samples, such as, but not limited to, cotton, is important for determining the market value of a particular batch of material, as well as for determining a suitable usage and what processing may be required in gins or spinning mills. Today, nearly 100% of the cotton grown in the United States is classed employing testing instruments. Testing includes determining such characteristics as fiber length, as well as the content of undesired textile entities such as trash and neps.

As a relatively early example, a comb-like device for preparing a sample of ginned cotton for measuring the fiber length thereof is disclosed in Hertel U.S. Pat. No. 2,404,708, which issued in 1946. That same inventor later developed what is now known as a Hertel needle sampler, disclosed in Hertel U.S. Pat. No. 3,057,019. The Hertel needle sampler is a comb-like device arranged for movement past a perforated plate which has a fibrous mass pushed against the opposite side so that portions of the fibrous mass protrude through the perforations and are loaded onto the needles. A screw-thread based locking device then retains the fibers on the needle sampler, forming what is known in the art as a tapered beard because the fibers are of varying lengths. The tapered beard is prepared by combing and brushing to parallelize the fibers, as well as to remove loose fibers. Automated versions of the Hertel needle sampler have been developed.

The tapered beard is then subjected to analysis. For example, an instrument known as a Fibrograph is employed to optically determine various characteristics of the tapered beard, including the profile along its length. In addition, a separate test may be made of the strength of the tapered beard.

In some respects, the sample as taken by a Hertel needle sampler and the measurement of length and strength therefrom, are worldwide standards.

The Hertel needle sampler approach involves collectively testing, essentially simultaneously, all of the fibers of a sample, assumed to be a representative sample.

An alternative approach is to individualize and test single fibers and other textile entities, for example neps and trash. Testing single fiber entities can provide a better analysis.

However, such an approach conventionally requires that entities be individualized and fed one at a time into suitable analysis means for testing. A device for such individualizing is generally termed a "fiber individualizer," and is generally so termed herein, although a more precise term is "entity individualizer" since, for purposes of testing, it is necessary to accurately determine the amount of neps and trash in a particular sample, in addition to characteristics of the fibers themselves.

An example of such single entity testing apparatus is disclosed in Shofner U.S. Pat. Nos. 4,512,060 and 4,686,744, which disclose what is termed in those patents a microdust and trash machine (MTM), and what has since become known as an advanced fiber information system (AFIS), currently manufactured by Zellweger Uster, Inc. in Knoxville, Tennessee.

In one form, the AFIS machine separates fibers and neps into one airstream, and trash into another air stream. Optical-based sensors then measure the individual entitles. Individual entities can be analyzed at rates as high as 1000 per second. An AFIS more particularly includes an aeromechanical separator or fiber individualizer; high speed entity sensors; and a high information rate computer for data collection and analysis.

Improvements to the AFIS, particularly improved sensors where a single sensor analyzes neps, trash and fibers individualized all in one air stream are disclosed in Shofner et al U.S. Pat. No. 5,270,787, titled "Electro-Optical Methods and Apparatus for High Speed, Multivariate Measurement of Individual Entities in Fiber or Other Samples;" in Shofner et al U.S. Pat. No. 5,321,496, titled "Apparatus for Monitoring Trash in a Fiber Sample;" and in Shofner et al U.S. Pat. No. 5,469,253, titled "Apparatus and Method for Testing Multiple Characteristics of Single Textile Sample with Automatic Feed."

The fiber individualizer portion of an AFIS, such as is disclosed in U.S. Pat. Nos. 4,512,060 and 4,686,744, includes a cylindrical rotating beater wheel having projections which engage fibers of fibrous material fed to the beater wheel for testing. The beater wheel rotates at typically 7,500 rpm, which a circumferential velocity of 5,000 FPM, and is similar to the licker-in of a conventional carding machine, or the beater stage of an open-end spinning head, with the exception that the AFIS beater wheel includes perforations which allow radially inward airflow.

The perforations in the prior art beater wheel and, more particularly, the radially inward air flow through the perforations, is significant in that it causes the fibers to engage the pins on the rotating beater wheel. If fiber is merely presented to a rotating beater wheel, the fiber tends to run away and not engage. As a result, the entities are not individualized well, neps are produced, and trash is not removed as efficiently.

While quite effective, a rotating perforated cylinder, normally also requiring a stationary shoe inside connected to a vacuum source for drawing air radially in through the perforations, is a relatively expensive device to manufacture.

Conventional practice, particularly in processing operations, is to simply present fiber to a rotating beater wheel, typically from a feed roller, with no particular air flow introduced at all. This approach suffers the disadvantages that it does not individualize well, neps are produced and trash is not removed effectively.

SUMMARY OF THE INVENTION

Accordingly, it is an object of the invention to provide a beater wheel type individualizer, particularly for the purpose of measurement and classification of individual entities in a fiber sample, which does not employ a perforated beater wheel as described hereinabove, but which nevertheless has good engagement of the fibers with pins on the beater wheel.

Briefly, and in accordance with the invention, an aeromechanical individualizer for individualizing entities within a fiber sample includes a cylindrical rotating beater wheel, having a non-permeable cylindrical surface and having carding elements, such as pins or wire points, on the cylindrical surface. A cylindrical feed roller and feed plate supply the fiber sample to the beater wheel in the form of a beard at a first point along the rotational path thereof. A nozzle directs a gas flow across the feed plate and the beard such that fibers are dragged from the feed plate into engagement with the carding element.

At a second point along the rotational path of the beater wheel there is a doffer for removing entities of the beater wheel.

An enclosure surrounds the beater wheel and substantially prevents the ingress or egress of the gas except gas flow which enters via the nozzle at the first point and which exits at the second point.

A card flat may be provided at a third point along the rotational path of the beater wheel intermediate the first and second points.

The beater wheel rotates in a direction such that the surface thereof moves towards the nozzle, and the nozzle supplies gas flow at a velocity at least as great as the circumferential velocity of the beater wheel.

The individualizer of the subject invention is particularly adapted for use in conjunction with measurement apparatus disclosed in concurrently filed United States patent application Ser. No. 08/944,912 filed Oct. 6, 1997, by Frederick M. Shofner and David A. Hinkle, titled "High Throughput Nep Measurement," the entire disclosure of which is hereby expressly incorporated by reference. A characteristic of that apparatus is much higher throughput. In particular, multiple individualized entities (mostly fibers and occasional neps) are directed through a sensing volume at one time.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description, taken in conjunction with the drawings, in which:

DETAILED DESCRIPTION

Figure 1:
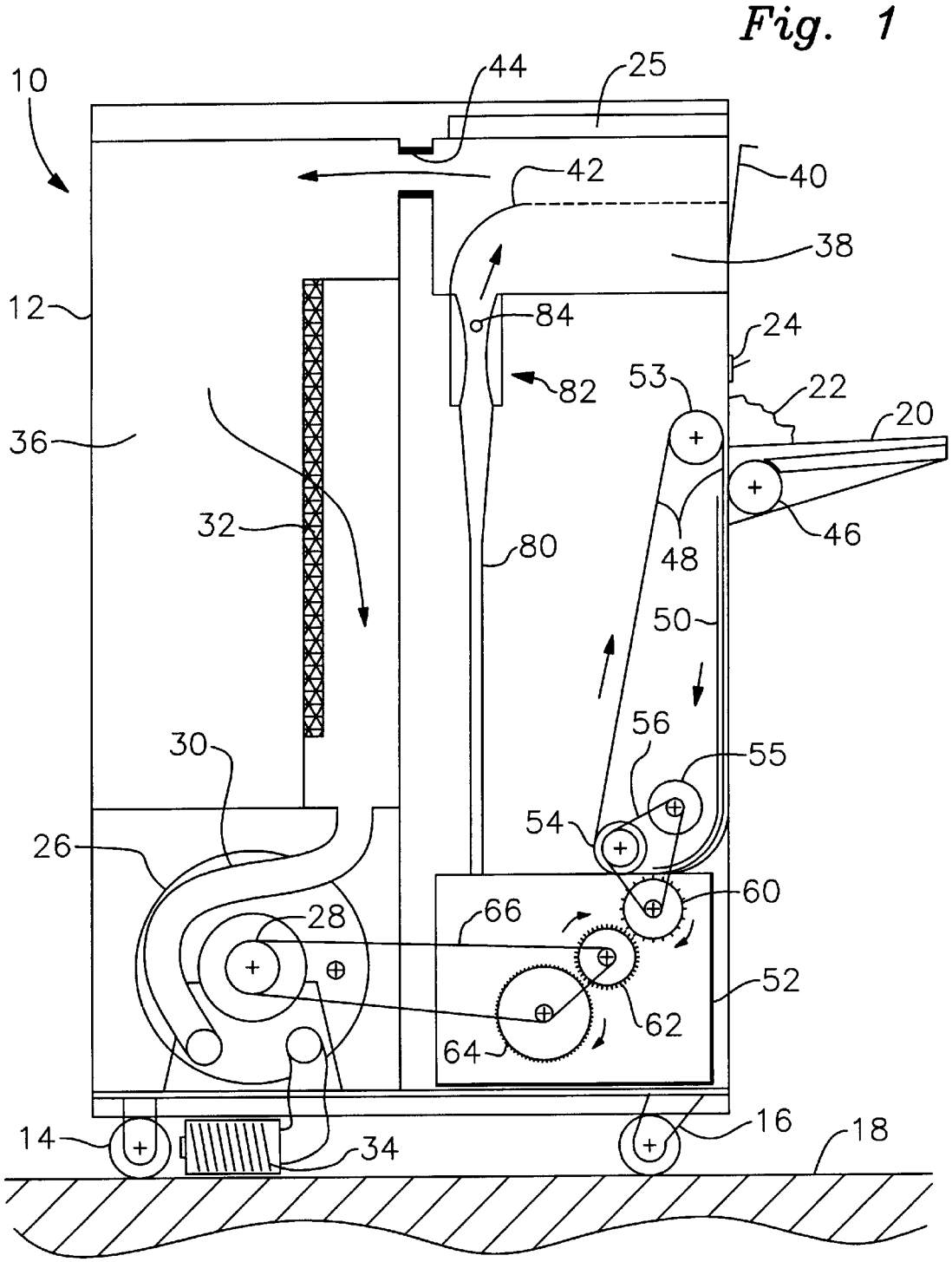
FIG. 1 is a diagrammatic view of a self-contained apparatus for rapidly testing a fiber sample to measure the quantity and size distribution of nep-like entities in the fiber sample.

Referring first to FIG. 1, self-contained apparatus 10 for testing fiber samples has an outer enclosure 12 supported by wheels and casters 14 and 16 for convenient movement about a floor surface 18.

The apparatus includes a feed table, generally designated 20, on which a fiber sample 22 is placed, such as a ten-gram cotton sample. The testing apparatus 10 is activated by means of a on/off switch 24, whereupon the cotton fiber sample 22 is drawn into the machine 10, to be individualized and analyzed. Included within the apparatus is an electronics module 25 comprising an analyzer.

In general, entities comprising the fiber sample 22 are transported through the apparatus 10 by means of a gas flow stream, drawn by a blower unit 26, which accordingly provides suction. The blower 26 is driven by a motor 28 and draws air flow via a blower inlet 30 through a filter 32, and exhausts air via a silencer 34. Following testing, the cotton fiber sample 22, which at that point comprises lint, is collected either in a large lint box 36 or a small lint box 38, and periodically removed. The small lint box 38 has an access door 40, and a removable deflector/screen 42 inside. When the deflector/screen 42 is in place, lint remains in the small lint box 38. When the deflector/screen 42 is removed, lint travels through an opening 44 into the large lint box 36. The small lint box 38 is generally employed for a sample-by-sample mode, and the large lint box 36 for a continuous mode.

The feed table 20 includes a roller 46, and transfers the fiber sample to a feed belt 48 of conventional construction, backed by a stationary plate 50, which delivers the fiber sample to an aeromechanical individualizer 52, described hereinbelow in detail with reference to FIG. 2. The belt 48 is guided by representative pulleys 53 and 54, driven by a motor 55 and rive chain 56.

Very briefly, the individualizer 52 includes a cylindrical feed roller 60, a first cylindrical rotating beater wheel 62, and a second cylindrical rotating beater wheel 64. It will be appreciated that the individualizer 52 in FIG. 1 is shown in a highly schematic representation, as a number of elements, such as enclosures for the cylindrical wheels 60, 62 and 64, are omitted. The feed roller 60 is driven by the motor 55 and belt 56 which drives the feed belt 48. The beater wheels 62 and 64 are powered via a drive belt 66 powered by the blower motor.

A significant difference between the individualizer 52 of FIG. 1 and typical prior art individualizers used for testing purposes is the feed rate. Thus, while the purpose of prior art individualizers for testing purposes is to deliver individualized entities one at a time to a downstream sensor, the individualizer 52 of the invention delivers individualized entities at a rate such that multiple entities, particularly fibers, are delivered to a sensor at one time. Thus, the feed belt 48 and cylindrical wheels 60, 62 and 64 are wider than those of individualizers included in prior art apparatus for fiber testing, such as eight inches in width, compared to one inch or less in width in the prior art.

The output of individualizer 52 is delivered to an air stream drawn through a transport duct 80 to an acceleration/deceleration gas flow nozzle 82, including a sensing volume, generally designated 84. The transport duct 80 is rectangular in cross-section, approximately 0.5 inch in thickness (the dimension visible in the FIG. 1 orientation), and approximately eight inches across, consistent with the width of the rolls 60, 62 and 64, and consistent with the relatively higher feed rate of the testing apparatus of FIG. 10, compared to prior art apparatus.

The acceleration/deceleration gas flow nozzle 82 and sensing volume 84 are elements of nep measurement apparatus disclosed in the above-incorporated concurrently-filed United States patent application Ser. No. 08/944,912 filed Oct. 6, 1997. Individualized entities comprising fibers and neps are presented to the nozzle 82 at a throughput rate such that at least portions of multiple fibers, for example thirty fibers, and occasional single neps, are presented to the sensing volume 84 at one time.

After passing-through the acceleration/deceleration gas flow nozzle 82, the fiber and other entities are collected either in the small lint box 34 or the large lint box 36, depending on whether the deflector/screen 42 is in place, for subsequent removal.

Figure 2:
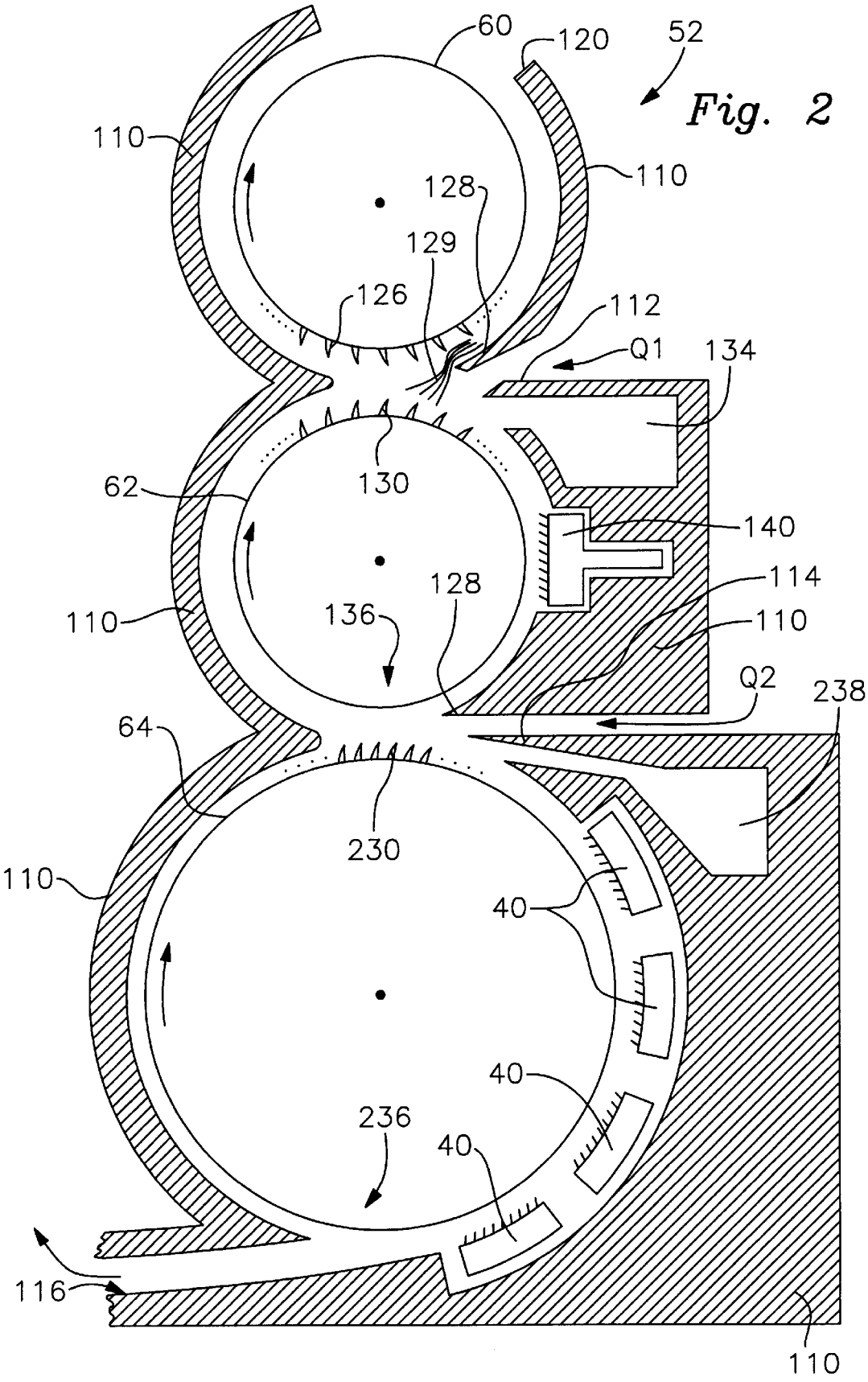
FIG. 2 is an enlarged view depicting the fiber individualizer included in the FIG. 1 apparatus.

Referring now to FIG. 2, a significant aspect of the individualizer 52 is that it is, in general, tightly sealed such that air flow enters and exits at well-defined points. Thus, an enclosure 110 surrounds the feed roller 60, as well as the beater wheels 62 and 64 such that the only entering air flows are air flow $Q_1$ entering via nozzle 112, directed towards the first beater wheel 62, and air flow $Q_2$ entering via nozzle 114, and directed towards the second beater wheel 64. Air flow exits via a passage way 116, drawn by suction from the blower 26, to be directed into the transport duct 80 via a transition piece (not shown). Above the cylindrical feed roller 60 is a fiber input opening 120 supplied from the feed belt 48. The arrangement is such that little air enters via the port 120.

Although the illustrated embodiment includes first and second cylindrical rotating beater wheels 62 and 64, comprising a two-stage machine, in accordance with the invention only a single rotating beater wheel is required. Unlike the beater wheels of Shofner U.S. Pat. Nos. 4,686,744 and 4,512,060, the beater wheels 62 and 64 have cylindrical surfaces that are non-permeable.

The feed roller 60 is, for example, three inches in diameter, approximately eight inches in width, and rotates at 11 rpm. On the surface of the feed roller 60 are a plurality of teeth 126, which are raked at a reverse angle with reference to the rotational direction of the feed roller 60, clockwise in the FIG. 2 orientation.

A portion of the housing 110 comprises a feed plate 128, defining a first point along the rotational path of the wheel 62 on which a "beard" 129 of fibers and other entities collects, to be fed into engagement with pins 130 on the first cylindrical rotating beater wheel 62. The beater wheel 62 is for example three inches in diameter, approximately eight inches in width, and rotates at 3,500 rpm.

The pins 130, which may be termed carding elements, comprise, for example, points on conventional card wire, wound around the wheel 62, at a typical density of 800 points per square inch.

Formed in the enclosure 110 at 134 is a trash compartment into which trash is thrown in the manner disclosed in the above-identified Shofner U.S. Pat. Nos. 4,686,744, and 4,512,060, differing however, in that rather than comprising a counterflow slot through which air flows, the compartment 134 is sealed. A door (not shown) may be provided for periodically emptying the trash compartment 134, or the machine may be operated in a cleaning mode during which air flow blown through the machine blows trash particles out of the compartment 134.

At a second point along the rotational path of the beater wheel 62 is a doffer, generally designated 136, which in the disclosed embodiment comprises a feed to the second cylindrical rotating beater wheel 64. Doffing occurs primarily by airflow drawing entities off of the beater wheel 62, aided by opposing rotation of the wheel 64.

Intermediate the feed point and the doffer 136 is a card flat 140, connected to the enclosure 110 in a manner such that outside air does not enter in the vicinity of the card flat 140. The card flat 140 significantly enhances the individualizing process.

During operation, gas flow from the nozzle 112 is directed across the beard such that fibers are dragged from the feed plate 128 into engagement with the carding elements 130. Thus, good engagement with the carding elements 130 results.

The optional second cylindrical rotating beater wheel 64 is essentially identical in construction and operation. The second cylindrical rotating beater wheel 64 is approximately six inches in diameter, and rotates at 4,000 rpm. Air flow entering at $Q_2$ via nozzle 114 causes fibers from a feed plate 228 to engage on carding elements 230, which fibers and other entities are then doffed by vacuum pull at 236 to exit at 116. A trash compartment 238 is likewise provided, as well as multiple card flats 240.

By way of example, combined airflow $Q_1$ plus $Q_2$ is 50 CFM, and the velocity through the nozzles 112 and 114 is approximately 50 ft/sec. Nozzle velocity should be at least as great as the circumferential velocity of the beater wheels 62 and 64. A higher velocity results in a higher energy consumption, without necessarily an increase in performance.

While specific embodiments of the invention have been illustrated and described herein, it is realized that numerous modifications and changes will occur to those skilled in the art. It is therefore to be understood that the appended claims are intended to cover all such modifications and changes that fall within the true spirit and scope of the invention.

What is claimed is:

1. An aeromechanical individualizer for individualizing entities within a fiber sample, said individualizer comprising:

a cylindrical rotating beater wheel having a non-permeable cylindrical surface and having carding elements on said cylindrical surface;

a cylindrical feed roller and a feed plate for supplying the fiber sample to said beater wheel in the form of a beard at a first point along the rotational path thereof;

a nozzle directing a gas flow across the beard such that fibers are dragged from said feed plate into engagement with said carding elements;

a doffer for removing entities from said beater wheel at a second point along the rotational path thereof;

an enclosure surrounding said beater wheel and substantially preventing the ingress or egress of gas except gas flow which enters via said nozzle at the first point and which exits at the second point.

2. The aeromechanical individualizer of claim 1, which further comprises a card flat at a third point along the rotational path of said beater wheel intermediate the first and second points.

3. The aeromechanical individualizer of claim 1, wherein said beater wheel rotates in a direction such that the surface thereof moves towards said nozzle, and said nozzle supplies gas flow at a velocity at least as great as the circumferential velocity of said beater wheel.

* * * * *